United States Patent [19]

Hakes

[11] 4,172,615

[45] Oct. 30, 1979

[54] ROOF BOLTING APPARATUS

[75] Inventor: Gary A. Hakes, Hopewell, N.J.

[73] Assignees: Lee-Norse Company, Pittsburgh, Pa.;

[21] Appl. No.: 951,752

[22] Filed: Oct. 16, 1978

[51] Int. Cl.[2] ..... E21D 20/00

[52] U.S. Cl. ..... 299/30; 173/27; 173/159; 405/259

[58] Field of Search ..... 173/140, 152, 23, 27, 173/28, 159; 299/30, 11, 12; 405/259; 60/698, 719, 720

[56] References Cited

U.S. PATENT DOCUMENTS

| | | | |
|---|---|---|---|
| 2,771,273 | 11/1956 | Pond | 405/259 X |
| 3,682,253 | 8/1972 | Mantosh | 173/23 |
| 3,784,159 | 1/1974 | Skattman et al. | 173/23 |
| 3,912,024 | 10/1975 | Richmond | 173/152 |
| 3,951,215 | 4/1976 | Galis | 173/23 |

*Primary Examiner*—William Pate, III

*Attorney, Agent, or Firm*—Bernard J. Murphy

[57] ABSTRACT

The novel apparatus comprises a first, power unit module of limited mobility and a second, bolter unit which is flexibly and disengageably coupled to the first unit by means of an umbilical line. In one embodiment of the invention, the power module comprises the controls whereat and from when the satellite bolter is (remotely) operated, and in an alternate embodiment, the satellite bolter itself includes controls and a control station for an operator to be accommodated thereat, to control the bolter directly.

12 Claims, 5 Drawing Figures

ROOF BOLTING APPARATUS

Conventional roof bolting apparatus comprises electric motors, hydraulic pumps, hydraulic reservoirs, electric cable reels, a tram system, and chassis and operating station, in a basic, self-powered, bolter unit, such unit further having single or dual booms which support drills at the front to drill and bolt the roof of a cut in a coal mine. These units are typically eight or nine feet wide, twenty to thirty feet long, two to three and a half feet high and weigh between twenty and forty thousand pounds. Their boom systems (if dual) must span a width of fourteen to sixteen feet. Some units can bolt more than one row of bolts without relocation. Others must tram such large, heavy self-powered chassis across uneven mine floor once per bolt row (there being approximately a distance of four feet between bolt rows).

It is an object of this invention to set forth improved roof bolting apparatus which is not met with the limitations of mobility and/or maneuverability, as noted in the foregoing, which obtain in prior art apparatus of this type.

It is also an object of this invention to set forth a roof bolting apparatus comprising a first unit which defines a power module, a second unit which defines at least one satellite bolter; first coupling means which flexibly and disengageably couple said bolter remotely to said power module; and second coupling means which disengageably attach said bolter directly or immediately to said power module; wherein said module comprises a source of pressured hydraulic fluid; said bolter comprises hydraulic-fluid-operative tramming means, position-stabilizing jacks, and roof bolting means; and at least one of said coupling means comprises means for supplying pressured hydraulic fluid operative thereof to said tramming means, said stabilizing jacks, and said bolting means from said source.

Figure 1:
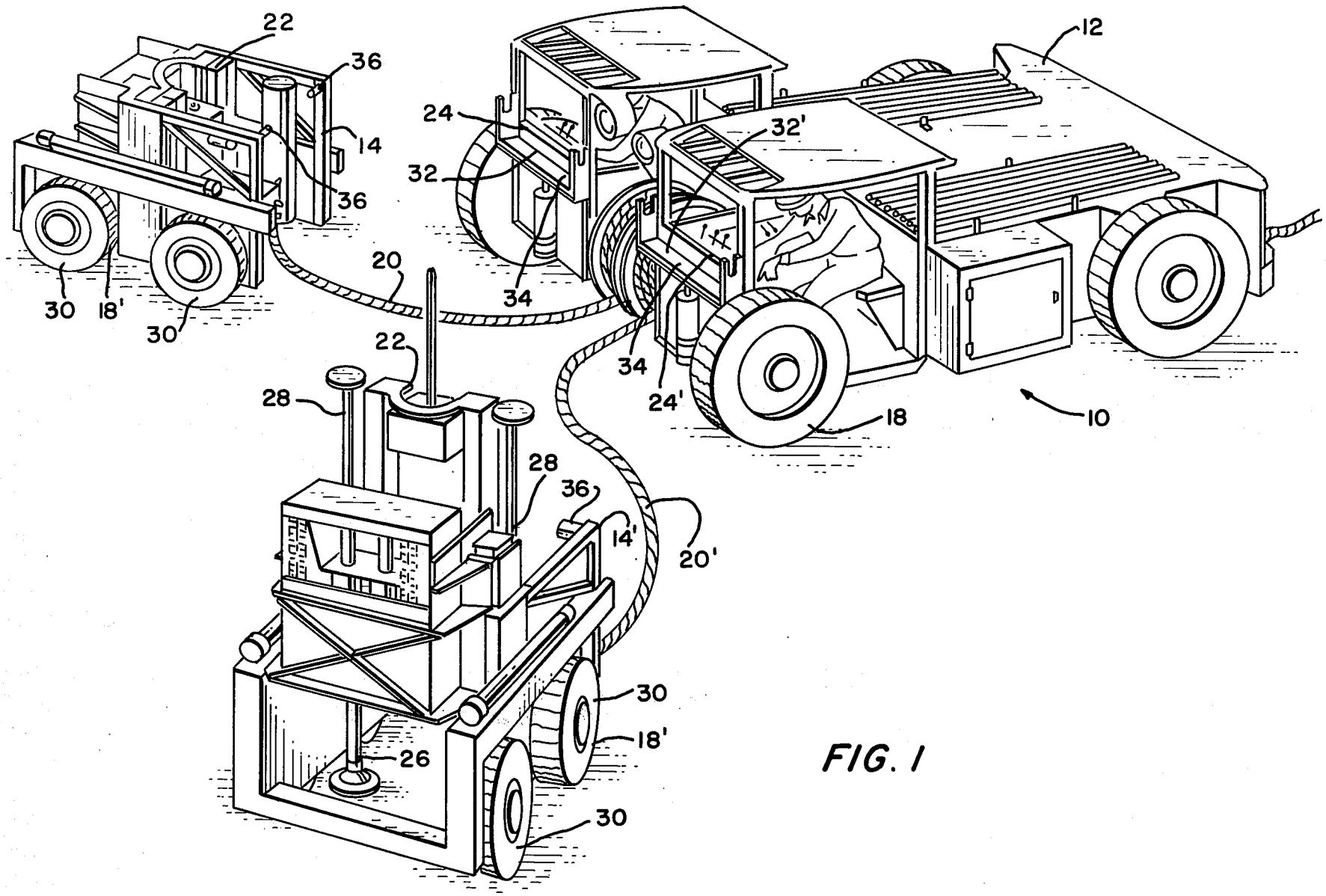
Figure 2:
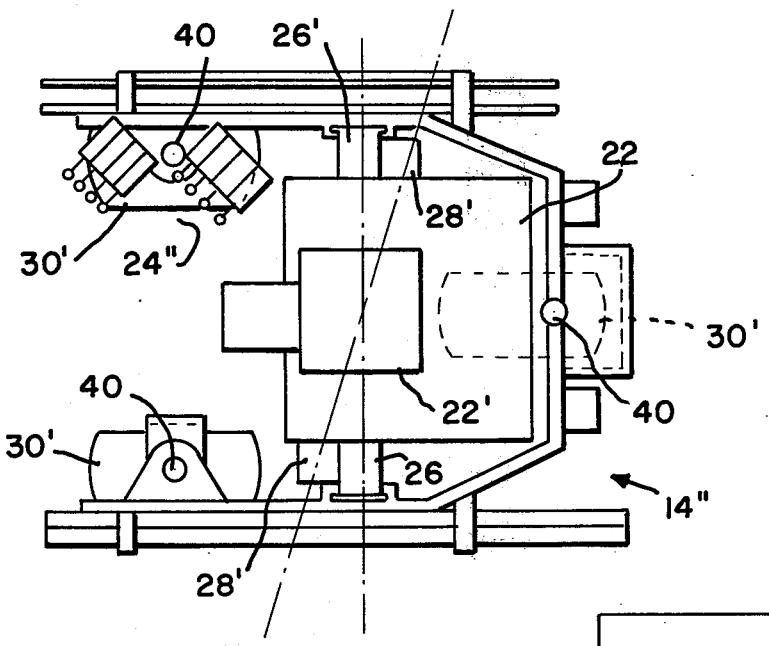
Figure 3:
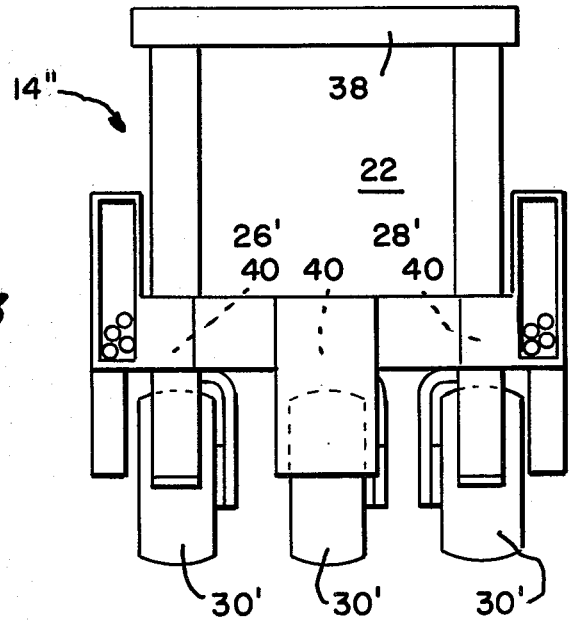
Figure 4:
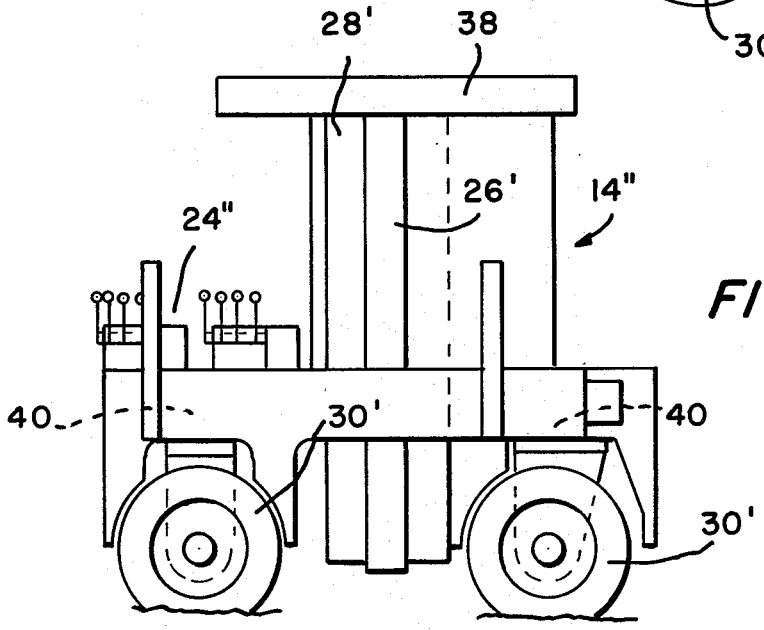
Figure 5:
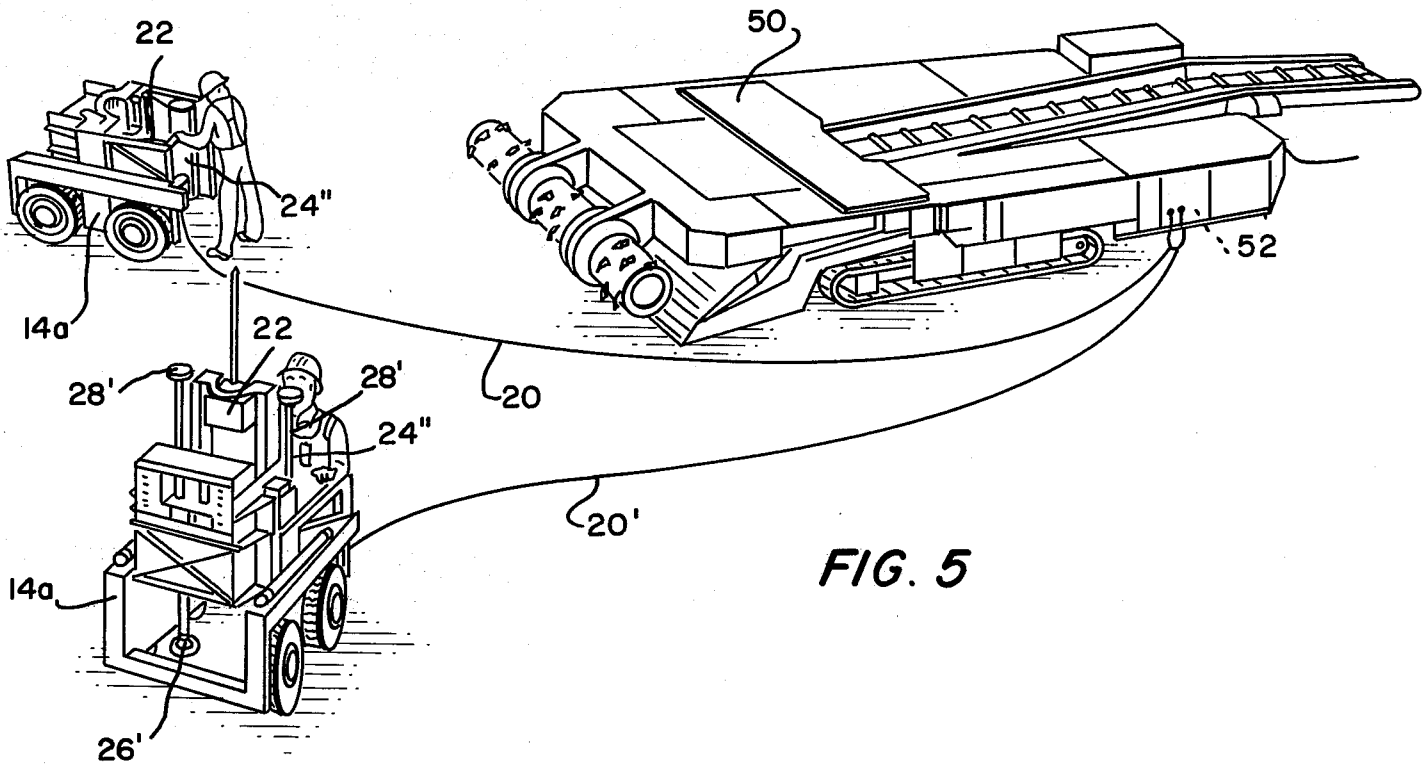

Further objects of this invention as well as the novel features thereof will become more apparent by reference to the following description taken in conjunction with the accompanying figures, in which:

FIG. 1, is a perspective view of an embodiment of the invention showing a power module and umbilical lines payed-out therefrom disengageably coupled to a pair of satellite bolters;

FIGS. 2, 3, and 4, depict a top view, front view and side elevation respectively, of an alternative embodiment of the novel satellite bolter; and FIG. 5 is a perspective view of yet another embodiment of the novel roof bolting apparatus in which the latter are satellites operating via umbilical lines payed-out from a mining machine.

Features of the invention, as shown in the figures, are exemplified by the first embodiment of the roof bolting apparatus 10 comprising a power unit 12 and satellite bolters 14 and 14'. The power unit 12 is a power conversion module comprised of an electric cable reel, electric motors, hydraulic pumps, and a hydraulic reservoir. The satellite bolters 14 and 14' each comprises a small self-propelled vehicle which is independent of the power unit 12, except for hydraulic power and inherently safe (low voltage, low amperage) electric control signal wires. Hydraulic fluid under pressure is communicated between the power unit 12 and the satellite bolters 14 and 14' by means of umbilical, hydraulic and electric lines assemblies 20 and 20'. Electric control signals originating from the operators in the operator stations on the power unit 12 also are communicated to the satellite bolter units 14 and 14' by means of the umbilical, hydraulic and electric lines assemblies 20 and 20'. Each line assembly comprises a hydraulic pressure line, a hydraulic return line, and multiple, inherently safe electrical signal wires assembled into a unitary package. The satellite bolters 14 and 14' do not incorporate a hydraulic reservoir, nor any major electric components except for: (1) inherently safe solenoid controlled hydraulic valves to activate the various satellite bolter functions and (2) battery powered headlights—not shown in FIG. 1. The bolters do not use booms either; instead of swinging or extending booms or rails to bolt a location, an entire satellite bolter trams to the bolting location. This is similar to non-pivoting single-boom machines. However, because the satellite bolters 14 and 14' are each built around a "mast module" 22 roof drilling and bolting concept, they are very compact. The invention comprises satellite bolter structures of less than four feet wide, three and a half to four and a half feet high and five to seven feet long. The drilling-/bolting "mast module" 22 (which, per se, is not the subject of this disclosure) delivers all working loads associated with drilling and bolting (or even pressing friction rock stabilizers) directly to the mine floor, thus relieving the chassis of the satellite bolters 14 and 14' of any structural working load requirements.

The satellite bolters 14 and 14' (of FIG. 1) are remotely controlled from the power unit 12 via operator's stations 24 and 24'. Station 24 remotely monitors and controls operation of satellite bolter 14 through the umbilical line assembly 20, and station 24' supervises bolter 14' via line assembly 20'. Each bolter has a floor jacking mechanism 26 and roof jacking mechanism 28 for positionally stabilizing the vehicle in selected bolting locations. The tram system 18' of this embodiment comprises hydraulically-powered wheels 30, and stations 24 and 24' comprise controls operative for braking and/or forwardly and reversibly powering selected ones of said wheels—whereby the bolters are highly-maneuverably steered.

The power unit 12 has a pair of vertical, hydraulically-operated lifts 32 and 32'. Each lift comprises a latching carriage 34 with a pair of oppositely-disposed, arcuate recesses for receiving therein the pair of stub-beams 36 which project inwardly atop one end of the bolter(s) frame(s). Either one or both of the bolters 14 and 14' can be trammed to a lift (or lifts) 32 and/or 32' for engagement thereof with the latching carriage(s) 34, and elevation from the ground, in order that said bolter(s) can be transported off to another mine cut, or whatever, by the power unit 12.

The alternative satellite bolters 14'' and **14*a* of FIGS. 2 through 4, and FIG. 5, like bolters 14 and 14' (of FIG. 1), are flexibly and disengageably coupled to a power unit (similar to power unit 12, FIG. 1) or to a continuous miner 50 (FIG. 5) by an umbilical, hydraulic line assembly 20, 20', FIG. 5. However, in these embodiments, bolters 14'' and 14*a* (and not their hydraulic-power supplying sources) have their own operator's stations 24''. Similar floor jacking and roof jacking mechanism, 26' and 28' respectively, are provided to give the bolters 14'' and 14*a* their stability. Same "mast modules" 22 for roof drilling and bolting are centrally carried by the bolters 14'' and 14*a*, and the axial centerlines of the jacking mechanisms, as can be seen in FIG. 2, exactly bisect the drill housings 22' (of the mast modules). The roof jacking mechanism, FIGS. 2–4, 28'** thereabove carries a canopy 38 for operator protection and shielding, and also for temporary roof support.

These bolters 14'' and 14a also have wheels 30', hydraulically powered (by means not shown) which, however, are supported on pivot axes 40, to accommodate lateral, as well as forward and reverse, selective movement thereof.

As will be appreciated, the advantages of my novel roof bolting apparatus over prior art apparatus are:

(1) Highly maneuverable; independent satellite bolters 14, 14', 14'' not constrained by boom-swing reach, or structural limitations.

(2) Versatility in the number of satellite bolters per power unit 12; i.e., one, two, three, four or more bolters can be operated from one such power unit, if desired.

(3) High mobility—Example 1: Four satellite bolters can pass (single file) a power unit in the middle of a cut, or off to one side of a cut, rearrange themselves four abreast, and proceed to bolt an entry, bolting all four bolts in a row simultaneously. They can subsequently advance four feet (still four abreast) and bolt each additional row.

Example 2: One or more satellite bolters can be quickly disconnected from a power unit 12 and towed or motored away (using another power source) for use with a different power module, or for repair and/or maintenance. A damaged satellite bolter can be exchanged with a "spare" while the damaged one is rebuilt or repaired at a central repair facility (perhaps even above ground, due to the small size and weight of these satellite bolters).

(4) If the power unit 12 is left one crossout back in incoming air, and only the satellite bolters, with their totally hydraulic power, operated at the face, the bolters would be inherently safer than any bolter using electric power.

(5) Satellite bolters 14, 14' and 14'' can operate as far in advance of the power unit 12 as desired. Long hydraulic line assemblies 20 and 20' would be the principal disadvantage of great distances between power unit and satellite bolters.

(6) Due to the limited, compact dimensions of the bolters, very narrow passages can be bolted.

(7) Safe escape route; operator at station 24'' always operates the satellite bolter 14'' (FIGS. 2, 3, and 4) from directly behind. Therefore, even in this operator-manned embodiment, the operator's escape path is straight back without any obstructions (such as booms, etc.), at least until he has come back as far as the power unit 12.

(8) It is not necessary to move the power unit 12 as often as the satellite bolters.

(9) At least the bolters 14'' of FIGS. 2, 3, and 4 include all-wheel pivot steering and can therefore move forward to a bolt location, bolt it, pivot all wheels 30' ninety degrees of arc, and move sideways four feet to the adjacent bolt position and bolt it, and so on.

(10) The satellite bolters 14a (FIG. 5) are supplied with hydraulic power, via line assemblies 20 and 20', from the hydraulic circuit 52 of the continuous miner in this configuration there is no requirement for the continuous miner 50 to leave the cut or "place-change"; it has only to back up a sufficient distance to allow the bolters 14a operating space between the miner's cutterhead and the mine face. Thus, the miner 50 (FIG. 5) replaces the power unit 12 (FIG. 1). This novel combination of satellite bolters 14a and continuous miner 50 allows a closer approach toward truly continuous mining.

While I have described my invention in connection with specific embodiments thereof, it is to be clearly understood that this is done only by way of example and not by limitation to the scope of my invention as set forth in the objects thereof, and in the appended claims.

I claim:

1. Roof bolting apparatus, comprising:

a first unit which defines a power module;

a second unit which defines at least one satellite bolter;

first coupling means which flexibly and disengageably couple said bolter remotely to said module; and second coupling means which disengageably attach said bolter directly or immediately to said power module; wherein said module comprises a source of pressured hydraulic fluid;

said bolter comprises hydraulic-fluid-operative tramming means, position-stabilizing jacks, and roof bolting means; and at least one of said coupling means comprises means for supplying pressured hydraulic fluid operative thereof to said tramming means, said stabilizing jacks, and said bolting means from said source.

2. Roof bolting apparatus, according to claim 1, wherein:

said one coupling means comprises an umbilical coupling.

3. Roof bolting apparatus, according to claim 2, wherein:

said umbilical coupling comprises a hydraulic hose.

4. Roof bolting apparatus, according to claim 3, wherein:

one of said first and second units carries thereon a supply of said hydraulic hose and means for payout and retrieval thereof to and from the other of said first and second units.

5. Roof bolting apparatus, according to claim 1, wherein:

said power module has an operator's console whereat and from whence to operate said apparatus.

6. Roof bolting apparatus, according to claim 1, wherein:

said bolter has an operator's console whereat and from whence to operate said bolter.

7. Roof bolting apparatus, according to claim 1, wherein:

said roof bolting means comprises a roof drill housing located substantially centrally of said bolter;

said position-stabilizing jacks comprise at least one pair axially-extensible and vertically disposed floor-jacks spaced apart, astride said housing, and at least one pair of axially-extensible and vertically disposed roof jacks spaced apart, astride said housing;

axial centerlines of said floor jacks exactly bisect said drill housing; and axial centerlines of said roof jacks also exactly bisect said drill housing.

8. Roof bolting apparatus, according to claim 1, wherein:

said second coupling means comprises motor means for engaging and moving said at least one satellite bolter.

9. Roof bolting apparatus, according to claim 1, wherein:

said second coupling means comprises motor means for attaching thereto and moving a plurality of satellite bolters.

10. Roof bolting apparatus, according to claim 9, wherein:

said attaching and moving means comprises means for attaching thereto and raising, selectively, any one bolter of said plurality thereof, independently, and all bolters of said plurality thereof simultaneously.

11. Roof bolting apparatus, according to claim 1, wherein:

said tramming means comprises wheels, and means pivotally mounting said wheels to accommodate lateral, as well as forward, and reverse, travel of said bolter.

12. Roof bolting apparatus, according to claim 2, wherein:

said first unit comprises a mining machine.

* * * * *